US009099778B2

(12) United States Patent
Kawaguchi et al.

(10) Patent No.: US 9,099,778 B2
(45) Date of Patent: Aug. 4, 2015

(54) SUPERCONDUCTING ANTENNA DEVICE

(71) Applicant: Kabushiki Kaisha Toshiba, Minato-ku (JP)

(72) Inventors: Tamio Kawaguchi, Kawasaki (JP); Hiroyuki Kayano, Fujisawa (JP); Noritsugu Shiokawa, Yokohama (JP); Kohei Nakayama, Kawasaki (JP); Mutsuki Yamazaki, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 0 days.

(21) Appl. No.: 14/483,667

(22) Filed: Sep. 11, 2014

(65) Prior Publication Data

US 2015/0087522 A1 Mar. 26, 2015

(30) Foreign Application Priority Data

Sep. 25, 2013 (JP) ..... 2013-197852
Aug. 8, 2014 (JP) ..... 2014-162768

(51) Int. Cl.

| | |
|---|---|
| ***H01Q 21/06*** | (2006.01) |
| ***H01Q 1/36*** | (2006.01) |
| ***H01Q 21/30*** | (2006.01) |
| ***H01Q 21/00*** | (2006.01) |
| ***H01Q 1/42*** | (2006.01) |

(52) U.S. Cl.

CPC ..... *H01Q 1/364* (2013.01); *H01Q 1/42* (2013.01); *H01Q 21/0006* (2013.01); *H01Q 21/30* (2013.01)

(58) Field of Classification Search

CPC ..... H01F 6/065; G01R 33/3815
See application file for complete search history.

(56) References Cited

U.S. PATENT DOCUMENTS

| | | | | |
|---|---|---|---|---|
| 7,408,353 | B2 * | 8/2008 | Marek et al. | 324/318 |
| 7,825,751 | B2 * | 11/2010 | Kawaguchi et al. | 333/202 |
| 2007/0001910 | A1 | 1/2007 | Yamanaka et al. | |
| 2007/0164921 | A1 | 7/2007 | Hu et al. | |
| 2007/0257675 | A1 | 11/2007 | Marek et al. | |
| 2008/0055181 | A1 | 3/2008 | Kawaguchi et al. | |

FOREIGN PATENT DOCUMENTS

| | | |
|---|---|---|
| EP | 1 814 196 A1 | 8/2007 |
| EP | 2 511 981 A1 | 10/2012 |
| JP | 9-246837 | 9/1997 |
| JP | 2007-298518 | 11/2007 |
| JP | 2007-318271 | 12/2007 |
| WO | WO 94/02972 | 2/1994 |

OTHER PUBLICATIONS

Extended European Search Report issued Feb. 18, 2015 in Patent Application No. 14184361.5.

* cited by examiner

*Primary Examiner* — Colleen Dunn
(74) *Attorney, Agent, or Firm* — Oblon, McClelland, Maier & Neustadt, L.L.P.

(57) ABSTRACT

A superconducting antenna device of an embodiment includes an array antenna made by stacking a flat antenna having one or more antennas made of a superconducting material and a ground pattern on a low-loss dielectric substrate from a short wave band to an extremely-high frequency band, a vacuum chamber configured to accommodate the array antenna, a refrigerator configured to cool the array antenna, and a vacuum insulating window configured to pass an electromagnetic wave from a short wave band to an extremely-high frequency band in a direction of directivity of the array antenna in the vacuum chamber.

9 Claims, 7 Drawing Sheets

SUPERCONDUCTING ANTENNA DEVICE

CROSS-REFERENCE TO RELATED APPLICATION

This application is based upon and claims the benefit of priority from Japanese Patent Applications No. 2013-197852, filed on Sep. 25, 2013 and No. 2014-162768, filed on Aug. 8, 2014; the entire contents of which are incorporated herein by reference.

FIELD

Embodiments described herein relate to a superconducting antenna device.

BACKGROUND

Antennas used in radio equipment are required to be small size and a high sensitivity. In order to reduce the size of an antenna, a line width needs to be narrower. When a wiring material such as copper, gold and silver is used, a high frequency antenna in particular has a long wiring length, and for this reason, the loss caused by the wiring is high, and the antenna efficiency is reduced. On the other hand, when the size of area of an antenna is reduced, the gain of the antenna is likely to decrease.

DETAILED DESCRIPTION

A superconducting antenna device of an embodiment includes an array antenna made by stacking a flat antenna having one or more antennas made of a superconducting material and a ground pattern on a low-loss dielectric substrate from a short wave band to an extremely-high frequency band, a vacuum chamber configured to accommodate the array antenna, a refrigerator configured to cool the array antenna, and a vacuum insulating window configured to pass an electromagnetic wave from a short wave band to an extremely-high frequency band in a direction of directivity of the array antenna in the vacuum chamber.

First Embodiment

A superconducting antenna according to the first embodiment is a flat antenna having one or more antennas made of a superconducting material and a ground pattern on a low-loss dielectric substrate from a short wave band to an extremely-high frequency band. The distance between adjacent antennas patterns of the multiple antenna patterns is equal to or less than $\lambda/10$ where the resonator frequency of the antenna is denoted as $\lambda$.

Figure 1:
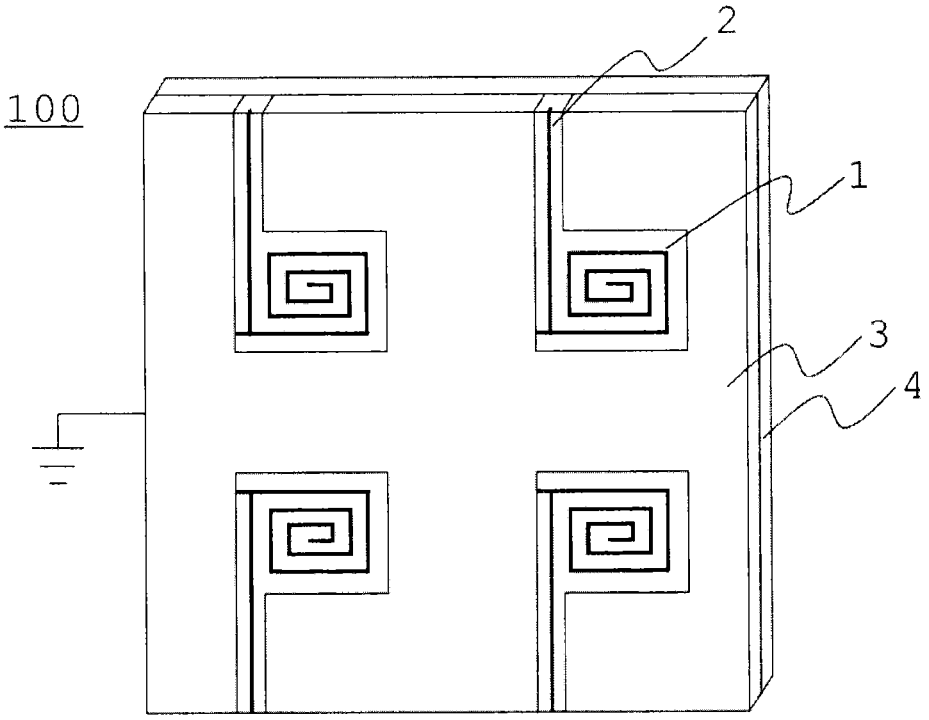
FIG. 1 is a schematic view illustrating a flat antenna according to an embodiment.

FIG. 1 illustrates a schematic diagram of a flat antenna 100 according to the embodiment. The flat antenna shown in the schematic diagram of FIG. 1 includes a superconducting antenna 1, a feeding path 2, a ground pattern 3, which are provided on a low loss dielectric substrate 4. The superconducting antennas 1 are formed on one side or both sides of the substrate.

The superconducting antenna 1 is made of a superconducting material. One or more superconducting antennas 1 are provided on the low loss dielectric substrate 4. The superconducting antenna 1 is made by processing an oxide superconducting thin film including one or more types of chemical elements such as Y, Ba, Cu, La, Ta, Bi, Sr, Ca, Pb into a desired antenna pattern shape. The shape processing may employ, for example, publicly known lithography technique. The pattern shape of the superconducting antenna 1 may be monopole, dipole, crank types, spiral types such as rectangular, circular, oval shapes, and an L type and an inverted F type. In addition, the superconducting antenna 1 may be an antenna configured as a CPW type which has both of the ground and the signal line on the same surface and configured to have a length an integral multiple of ¼ wavelength, and a slot antenna having a slot in a portion of the ground. In FIG. 1, four antennas are provided, but the number of antennas, the position, and the direction may be configured so that a preferred arrangement is selected appropriately in accordance with the purposes.

The superconducting antenna 1 has a microstrip line structure using an oxide superconducting thin film. The line width is equal to or less than several hundred μm, but since the superconducting material is used, the loss of the antenna 1 is low. Multiple superconducting antennas 1 have same resonant frequency.

The superconducting antenna 1 is cooled to a superconducting state when the antenna operates. The cooling temperature may be equal to or less than a desired temperature in accordance with the used superconducting thin film. The superconducting antenna 1 is connected to both of the feeding path 2 and the ground pattern 3.

The superconducting antenna 1 is fed via the feeding path 2. An antenna signal is input and output via the feeding path 2. The feeding path 2 is preferably made of the same material as the superconducting antenna 1 from the view point of manufacturing process.

When the superconducting antenna 1 is used, the interval between adjacent superconducting antennas 1 can be reduced to $\lambda/10$ or less where the resonant frequency of the superconducting antenna 1 is denoted as $\lambda$. An antenna made by processing a metal pattern in a normal conducting material such as copper, which has been used in the past, has a problem in that when the antenna size is reduced, the antenna gain decreases because of the loss caused by the reduction of the antenna size. In particular, the embodiment relates to an antenna for an electromagnetic wave from a short wave to an extremely-high frequency such as millimeter wave, and antenna for such a wavelength requires a wire length for a long antenna. The longer the length of the wire is, the more significant the effect of the loss becomes because of the reduction in the size of the antenna, and therefore, the antenna according to the embodiment has a problem that would not occur with an antenna that supports a wavelength such as a nanometer order. For this reason, in a case of a system that could not tolerate reduction of the gain at the antenna, the size of the longest side of the size of area occupied by the pattern of the antenna is preferably configured not to be equal to or less than λ/5 when the antenna using a normal conducting material is made into a smaller size. On the other hand, when the superconducting antenna 1 is used, the loss is so small that it can almost be disregarded, and therefore, the reduction in the antenna gain caused by the reduction in the size of the antenna is sufficiently low. Therefore, the antenna size can be reduced to λ/10 or less.

Since the wiring length is long, the size of area of the antenna is likely to increase. In a conventional antenna using a normal conducting material, the directivity of the antenna is not high enough to be used for the purpose of detailed inspection of, for example, a microwave. When superconducting wiring is employed for an antenna, the interval between the superconducting antennas 1 on the same surface is reduced to a sufficiently narrow interval of λ/10 or less, and multiple antennas are arranged, so that the antenna can be made into an array by arranging multiple antennas in a size of almost a single element of a conventional antenna, so that a high directivity can be achieved. In this case, the interval between the superconducting antennas 1 is the shortest distance between adjacent superconducting antennas 1. It should be noted that the interval between a superconducting antenna 1 on one side of a substrate and a superconducting antenna on the other side thereof preferably satisfies a condition of λ/10 or less because of similar reasons.

When the superconducting antenna 1 is in a spiral pattern, the longest side of the pattern shape is preferably equal to or less than 1/10 of the wiring length of the superconducting antenna 1. It is preferable to satisfy this condition from the perspective of the reduction in the size.

The feeding path 2 feeds electric power to the superconducting antenna 1. A delay line, phase shifter and a resistive film may be provided in a wiring circuit of the feeding path 2. When the delay line, phase shifter and the resistive film are provided, a phase and gain difference can be given to signals between antennas. When the phase difference can be given to signals between antennas, the signals between antennas can be separated. Examples of delay lines include a delay line for changing a signal path, a delay line for changing the inductance of a signal, and a delay line for changing the temperature of a superconducting line.

The ground pattern 3 is connected to each superconducting antenna 3. The ground pattern 3 may be a conductive film, but the ground pattern 3 is preferably constituted by the same superconducting material as the superconducting antenna 1 from the perspective of the manufacturing process.

The substrate of the superconducting antenna 1 is preferably made of a low loss dielectric substrate 4 of which loss is low from a short wave band to an extremely-high frequency band. Examples of low-loss materials include sapphire and MgO.

The flat antenna 100 can be manufactured by, for example, the following method. A superconducting oxide thin film is evaporated onto the low loss dielectric substrate 4 such as sapphire using laser vapor deposition method, sputtering method, vapor deposition method, chemical vapor deposition method, and the like. The superconducting oxide thin film made by evaporation can be processed by lithography technique using a mask having patterns of the antennas, the feeding path 2, and the ground pattern 3 formed thereon. It should be noted that the superconducting antenna 1 is such that the line width is narrow and the wiring length is long, and therefore, a superconducting oxide thin film is used. Because the pattern of the antennas 1 and the ground 3 are made by lithography, the interval between the antennas 1 can be reduced to a narrow interval of λ/10 or less.

Figure 2:
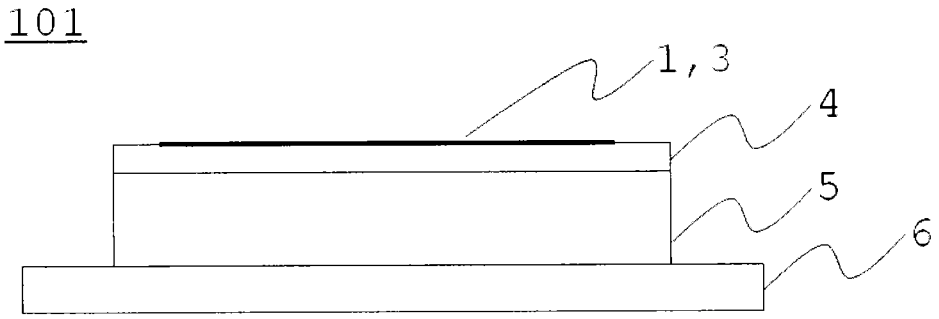
FIG. 2 is a schematic view illustrating the flat antenna according to the embodiment.

FIG. 2 illustrates a schematic diagram of a superconducting antenna device 101 having a metal plate 6 for radio wave reflection. When the superconducting antenna 1 is mounted, the superconducting antenna 1 is mounted with the dielectric 5 arranged on the metal plate 6 in an interposed manner, so that the directivity can be improved by making use of the reflected wave from the metal plate 6. In this case, the thickness of the dielectric substrate is such that, when the resonant frequency of the antenna is denoted as λ, the thickness of the dielectric substrate is preferably such a thickness at which the effective wavelength thereof is equal to or more than λ/8 and equal to or less than λ/4. The used dielectric substrate preferably has a lowered loss, as much as possible, for the electromagnetic wave transmitted and received.

Second Embodiment

The second embodiment relates to an array antenna made by stacking the flat antennas according to the first embodiment. The array antenna according to the embodiment is cooled by a refrigerator, not shown, and the antenna is in the superconducting state. From the perspective of improvement of the directivity and the gain, the flat antennas 100 are preferably used in a stacked manner.

Figure 3:
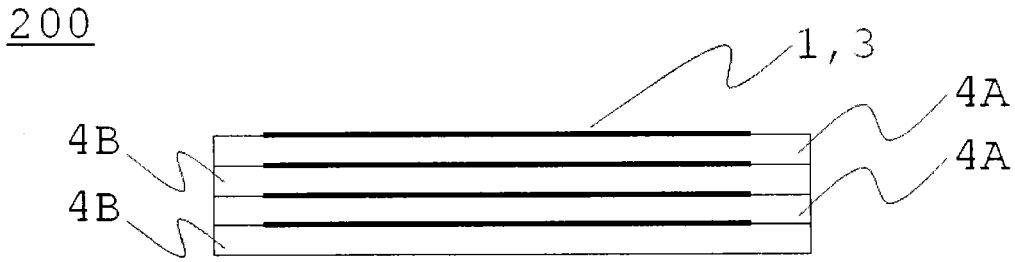
FIG. 3 is a schematic view illustrating a stacked flat antenna according to the embodiment.
Figure 4:
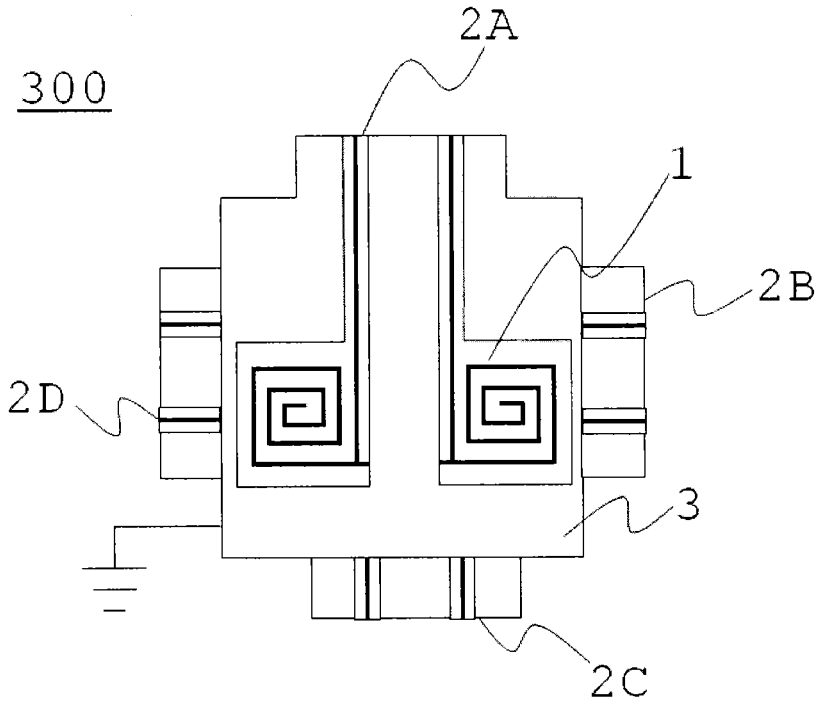
FIG. 4 is a schematic view illustrating a stacked flat antenna according to the embodiment.

The stacking form of the flat antennas is shown in the schematic diagrams of FIGS. 3 and 4, for example. The flat antenna of FIGS. 3 and 4 is an antenna in a form having two superconducting antennas on substrate. This shows an antenna in a form having a protruding portion of the feeding path. The antenna in the form having the protruding end portion of the feeding path is preferable from the perspective of connection with a circuit in a stage subsequent to the antenna.

An array antenna 200 shown in the cross sectional schematic diagram of FIG. 3 is in such form that flat antennas are stacked without shifting the superconducting antenna pattern. As shown in FIG. 3, four antenna layers are stacked. The four antenna layers may be in a form where a superconducting antenna is arranged on a surface of each dielectric substrate. Alternatively, the four antenna layers may be made by alternately stacking a dielectric substrate 4A having superconducting antennas 1 provided on both sides thereof and a dielectric substrate 4B having no superconducting antenna arranged thereon in order. In the latter form, the antennas are formed on both sides of the dielectric substrate 4A, and therefore, even when a substrate is warped during manufacturing, the superconducting antennas 1 provided on both sides of the dielectric substrate 4A can have the same thickness of the dielectric substrate which is shared by the superconducting antennas 1, and therefore, individual difference of the superconducting antennas 1 can be reduced. The array antenna in the form of FIG. 3 is a preferable from the perspective of improving the directivity of the antennas by using multiple antennas.

An array antenna 300 shown in the upper surface schematic diagram of FIG. 4 is in such form that the superconducting antenna patterns are stacked, each with 90 degrees rotation. In the array antenna of FIG. 4, an antenna layer A denoted with a reference symbol A, an antenna layer B denoted with a reference symbol B, an antenna layer C denoted with a reference symbol C, and an antenna layer D denoted with a reference symbol D are shifted 90 degrees in the order of stacked layers. In the array antenna 300 in the form of FIG. 4, end portions 2A, 2B, 2C, and 2D of the feeding paths of all the flat antennas stacked are arranged in different directions, or the end portions of the feeding paths of the flat antennas stacked immediately above or below are arranged in different directions. The array antenna 300 in the form of FIG. 3 is a preferable shape from the perspective of suppression of coupling of antennas with each other.

Third Embodiment

The third embodiment relates to an antenna device in such form that an array antenna is arranged in a vacuum chamber. A superconducting antenna device according to the embodiment preferably includes an array antenna made by stacking flat antennas each having an antenna made of a superconducting material and a ground pattern on a low-loss dielectric substrate from a short wave band to an extremely-high frequency band, a vacuum chamber accommodating the array antenna, a refrigerator cooling the array antenna, and a vacuum insulating window which passes an electromagnetic wave from a short wave band to an extremely-high frequency band in a direction of directivity of the array antenna in the vacuum chamber.

Figure 5:
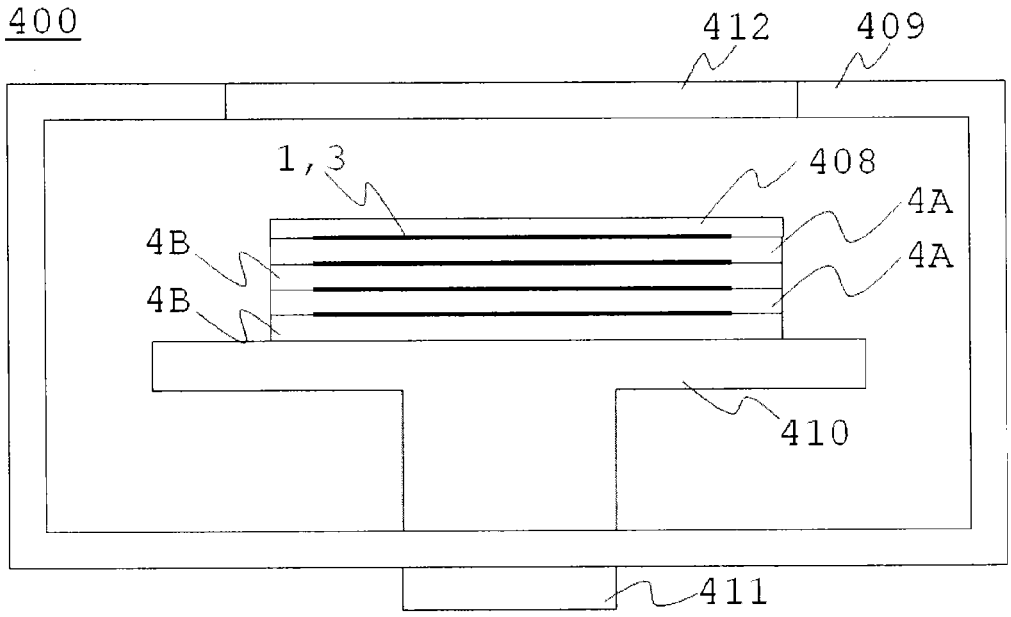
FIG. 5 is a schematic view illustrating the antenna device according to the embodiment.

The schematic diagram of FIG. 5 illustrates an antenna device 400 according to the embodiment. The antenna device 400 includes a first superconducting antenna layer 401, a first substrate 402, a second superconducting antenna layer 403, a second substrate 404, a third superconducting antenna layer 405, a third substrate 406, a superconducting ground layer 407, an infrared reflection film 408, a vacuum chamber 409, a cold head 410, a refrigerator 411, and a vacuum insulating window 412.

The array antenna according to the embodiment includes the first superconducting antenna layer 401, the first substrate 402, the second superconducting antenna layer 403, the second substrate 404, the third superconducting antenna layer 405, the third substrate 406, and the superconducting ground layer 407, which are stacked in this order. The antenna layer is provided with a feeding path, not shown. Each superconducting antenna layer is connected to the feeding path and the ground layer. The superconducting antenna layer and the substrate correspond to the flat antenna 100 according to the first embodiment.

The infrared reflection film 408 is a film for preventing infrared light heating the antenna from being incident upon the antenna. The infrared reflection film 408 is provided on the surface of the antenna facing the vacuum insulating window 412 on which the infrared light is incident (first superconducting antenna layer 401), and prevents the infrared light heating the superconducting antenna layer. The infrared reflection film 408 is, for example, a multi-layer film of metal oxide. For example, when there is no infrared light source, the infrared reflection film 408 may be omitted.

The vacuum chamber 409 is a chamber for keeping the temperature and the decompressed state in the space where the antennas are provided. An opening portion is provided in the direction of the highest directivity of the antennas of the vacuum chamber 409. The vacuum insulating window 412 is provided in the opening portion. The vacuum chamber 409 is made of metal such as stainless steel. Although not shown in the drawings, the vacuum chamber 409 is provided with a pump for decompressing the vacuum chamber 409. When a superconducting antenna is placed in a low temperature environment, the configuration for cooling the superconducting antenna inside of the vacuum chamber 409 and the like may be a configuration of a device in the low temperature environment.

The cold head 410 is a member for holding the array antenna and cooling the array antenna. The cold head 410 is thermally connected to the refrigerator 411, and is cooled by the refrigerator 411. The cooling temperature is different according to the superconducting oxide thin film of the array antenna, and is, for example, 77 K or less.

The refrigerator 411 is a member for cooling the cold head 410 for cooling the array antenna. The refrigerator 411 may be a refrigerator for an array antenna. Alternatively, when a refrigerator is already used in equipment into which the antenna device is incorporated, the refrigerator thereof can be used as the refrigerator 411. It should be noted that the refrigerator 411 is interpreted in a wide sense, and the refrigerator 411 includes a cooling refrigerant for making the array antenna into the superconducting state and a refrigerant chamber accommodating the cooling refrigerant. The cooling refrigerants include cryogen (liquid helium and liquid nitrogen).

The vacuum insulating window 412 is a window provided in the direction of the highest directivity of the array antenna of the vacuum chamber 409. The vacuum insulating window 412 is made of a member for transmitting an electromagnetic wave transmitted and received by the antennas, such as ceramics, glass, and acryl. When the size of area of the vacuum insulating window 412 is preferably almost equal to or more than the size of area of the array antenna, this is preferable from the view point that the transmission/reception of the signal is less likely to be obstructed.

Figure 6:
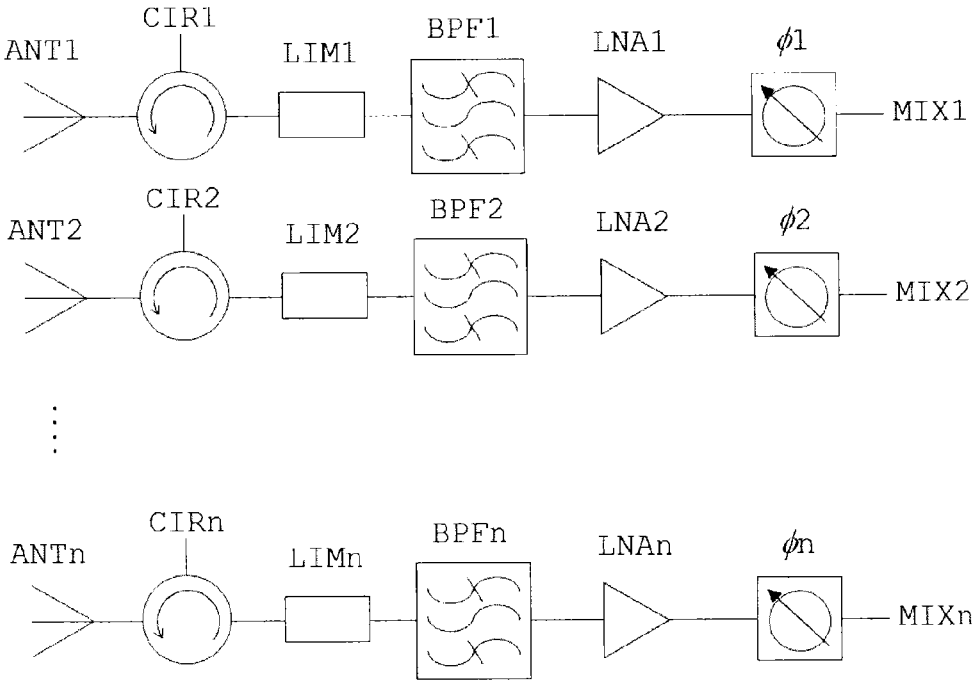
FIG. 6 is a block diagram illustrating a circuit of the antenna device according to the embodiment.

In this case, FIG. 6 illustrates a block diagram of a circuit of the antenna device according to the embodiment. The block diagram of FIG. 6 includes an antenna (ANT), a circulator (CIR), an amplitude limiter (LIM), a band pass filter (BPF), a low noise amplifier (LNA), and a phase shifter (Φ). The ATN1 to the ATNn represent a stacked array antenna. The antenna is connected to the amplitude limiter, the band pass filter, the low noise amplifier, and the phase shifter. FIG. 6 shows a block diagram having multiple antennas.

A radio wave is transmitted from an antenna such that electric power is provided via the circulator to the antenna, so that the radio wave is output. When a radio wave is received by an antenna, a signal that passes the circulator is processed by the amplitude limiter so that a signal having an amplitude larger than a threshold value is limited. A signal with a large amplitude may damage the circuit, and therefore, it is preferable to limit the amplitude before the amplification of the signal. The amplitude limiter is arranged in any given order between the circulator and the low noise amplifier. The signal that has passed the amplitude limiter passes through the band pass filter, which removes signals in a wavelength band other than the resonant frequency of the antenna. The signal that has passed the band pass filter is amplified by the low noise amplifier. The signal that has passed the low noise amplifier is processed by the phase shifter so that the phase is in synchronization with the phase of the signal from each antenna. When the antenna has a delay line provided, the phase shifter may be omitted. The signals that have passed the phase shifters are combined. If the phase shifters vary the phases to be passed, the beam of the array antenna can be scanned.

In the embodiment, the antenna employs a superconducting material, and the antenna is cooled so that it is in the superconducting state. Not only the antenna but also the circulator, the amplitude limiter, the band pass filter, and the low noise amplifier are preferably cooled from the perspective of improvement of the SN ratio of the signal (signal to noise ratio). For example, these circuits may be provided on the cold head, so that the cooling of the circuits and the cooling of the superconducting material can be done by the same refrigerator.

Fourth Embodiment

Figure 7:
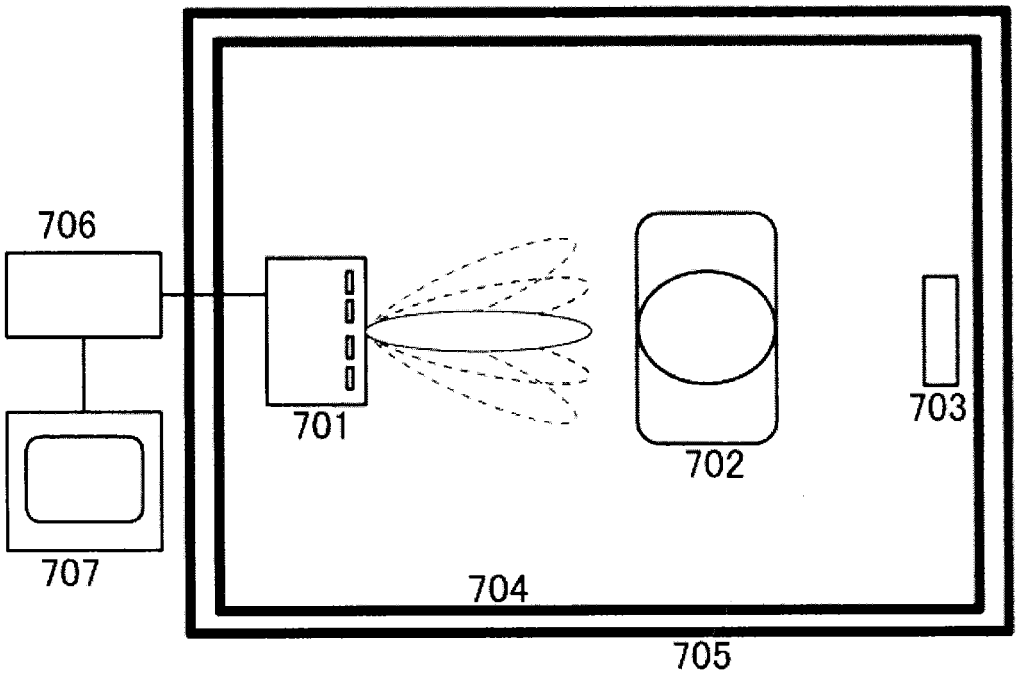
FIG. 7 is a schematic view illustrating a security device according to an embodiment.

The fourth embodiment is an embodiment of a security device using a superconducting antenna device as an antenna of a receiver. FIG. 7 illustrates a schematic view of a security device according to the fourth embodiment (measurement target is not included in the device). This device is an inspection device using microwave, and detects a dangerous object and the like possessed by a measurement target such as a human body from a weak radio wave that has passed through the measurement target.

The inspection device of FIG. 7 includes a receiver 701, a transmitter 703, an electromagnetic wave absorber 704, a metal wall 705, a calculator 706, and a display device 707. The measurement target 702 is preferably arranged between the receiver 701 and the transmitter 703.

The receiver 701 includes the superconducting antenna device explained above. The receiver can process the reception signal. The measurement target 702 may be a person, an animal, a baggage, and the like, and is not particularly limited. The transmitter 703 transmits an electromagnetic wave that can be received by the receiver 701. The transmitted electromagnetic wave is, for example, microwave. The electromagnetic wave absorber 704 is provided to absorb the electromagnetic wave so that that scattered electromagnetic wave is not reflected by the metal wall 705. The metal wall 705 is provided to prevent electromagnetic waves which become noises from entering from the outside. The calculator 706 makes image data by further processing the signal received by the receiver 701. The calculator 706 can detect presence/absence of danger and abnormality by comparing the measured reception data with reference data obtained based on information of the measurement target 702 that has been configured or the type or the size of the measurement target 702 recognized from an image captured by a camera, not shown. The result calculated by the calculator 706 can be displayed on the display device 707. The calculator 706 may also be a source of noises and therefore, the calculator 706 is preferably provided outside of the metal wall 705.

Figure 8:
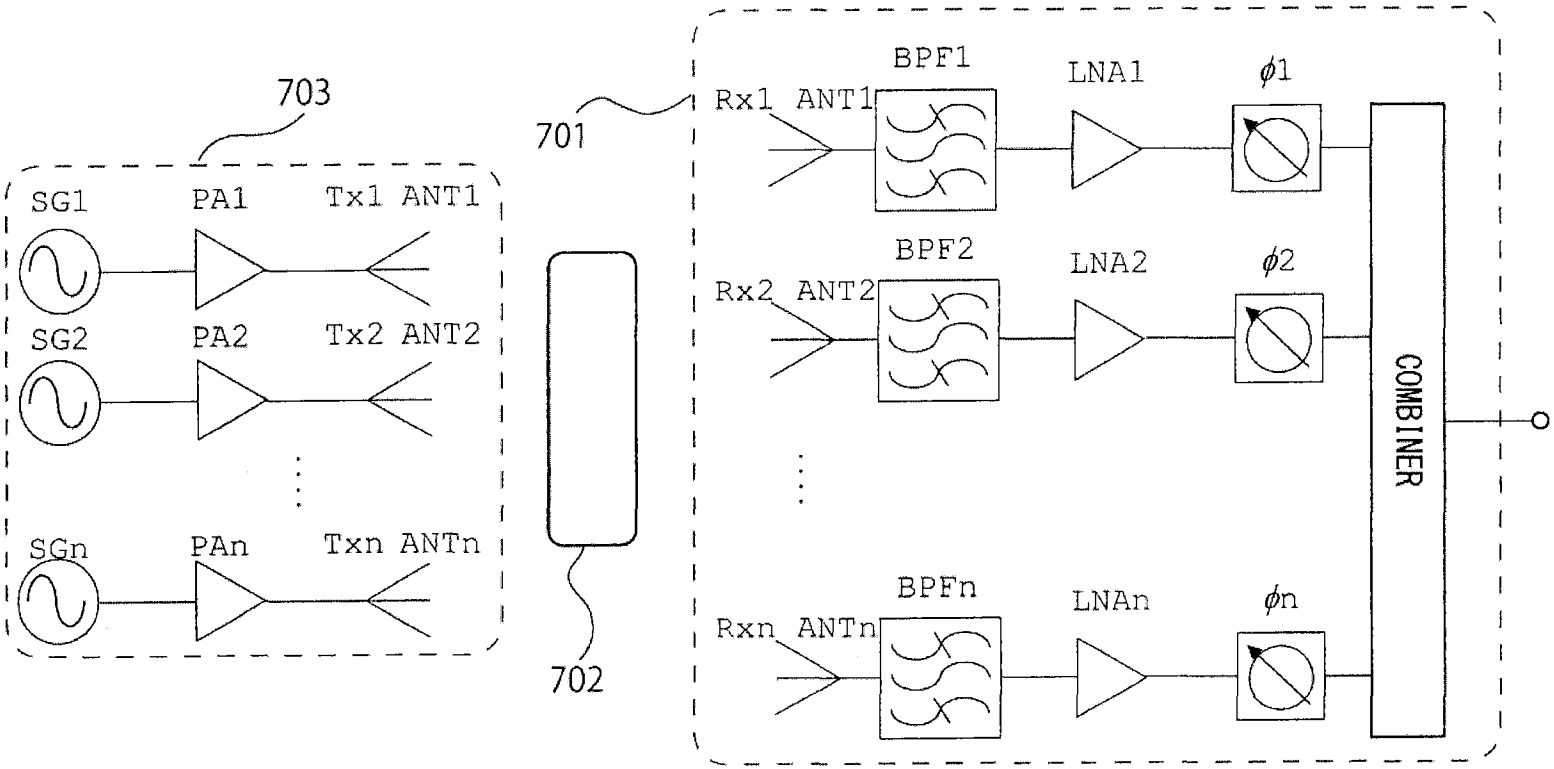
FIG. 8 is a block diagram illustrating a high frequency unit of the security device according to the embodiment.

FIG. 8 illustrates a block diagram of a high frequency unit of the security device. In the transmitter 703, the signal transmitted from the signal source (SG) is amplified by the power amplifier (PA) and is radiated from each transmission antenna (TX ANT). In this case, there may be a single transmission antenna, or multiple antennas may be used. The signal having transmitted through the measurement target is received by the receiver 701. In this case, the receiver 701 has at least one or more receiving antennas (RX ANTs), and includes a band pass filter (BPF) for limiting the band width for cutting unnecessary frequency components entering from the outside, a low noise amplifier (LNA) for increasing the reception sensitivity, a phase shifter (Φ) for controlling beam scanning, and a combiner for combining signals. In this device, because the signal that has passed through the measurement target is greatly attenuated and the signal level is greatly reduced, a high sensitivity receiver is required to detect the signals. Therefore, the low noise amplifier used for the receiver may be cooled to a low temperature. Alternatively, in the processing of the reception signal, the reception signal may be converted into a digital signal, and the digital signal may be processed. The combined signal is transmitted to the calculator 706 via a metal wire or an optical wire. FIG. 8 illustrates a block diagram where multiple transmitters 703 and multiple receivers 701 are provided.

When a microwave is used, not only metals but also the position of moisture, the amount of moisture, and the like can be measured from the dielectric constant of the measurement target. In order to reduce the inspection time, the receiver 701 uses a phased array antenna, and can perform scanning at a high speed by scanning the beam. In FIG. 7, the beam scanning of the receiver 701 is represented by an elliptic circle. The signal received by the receiver 701 is sent to the calculator to be analyzed, and the detection result is displayed on the monitor.

A high resolution performance is required for security inspection. In this case, in order to increase the resolution, the receiver 701 of this device has a structure of an array antenna made of multiple receiving antennas. By increasing the number of elements of the antennas, the directivity is increased, and the beam is narrowed, so that the resolution can be increased. On the other hand, in general, the signal level is more greatly attenuated by the measurement target as the frequency becomes higher, and therefore, it is desired to use a frequency as low as possible. For example, an electromagnetic wave of about 0.5 to 5 GHz is preferable for security inspection. However, in a case of an antenna using a normal conduction wiring material, the antenna size becomes larger when the frequency is lowered, and therefore, there is a problem in that an arrayed antenna does not fit within the inspection device. Therefore, in this device, an array antenna structure using a superconducting small antenna according to multiple embodiments is used as a receiving antenna. Therefore, this reduces the increase of the antenna size caused by use of a lower frequency, and a small security device still having a high sensitivity can be realized.

Image data can be obtained by processing data obtained in the inspection. The image data is compared with image data serving as a reference, whereby the position, the shape, the amount, and the like of a foreign object in the measurement target can be found. Therefore, foreign object detection including a dangerous object included in the measurement target can be done. It should be noted that the inspection based on microwave is advantageous in that the measurement target is exposed to lower level of radiation as compared with X-ray inspection. In addition, in contrast to an extremely-high frequency for measuring the surface of the measurement target, the measurement according to the embodiment detects a foreign object included in the measurement target, and therefore, the measurement according to the embodiment is more preferable from the perspective of privacy.

Fifth Embodiment

Figure 9:
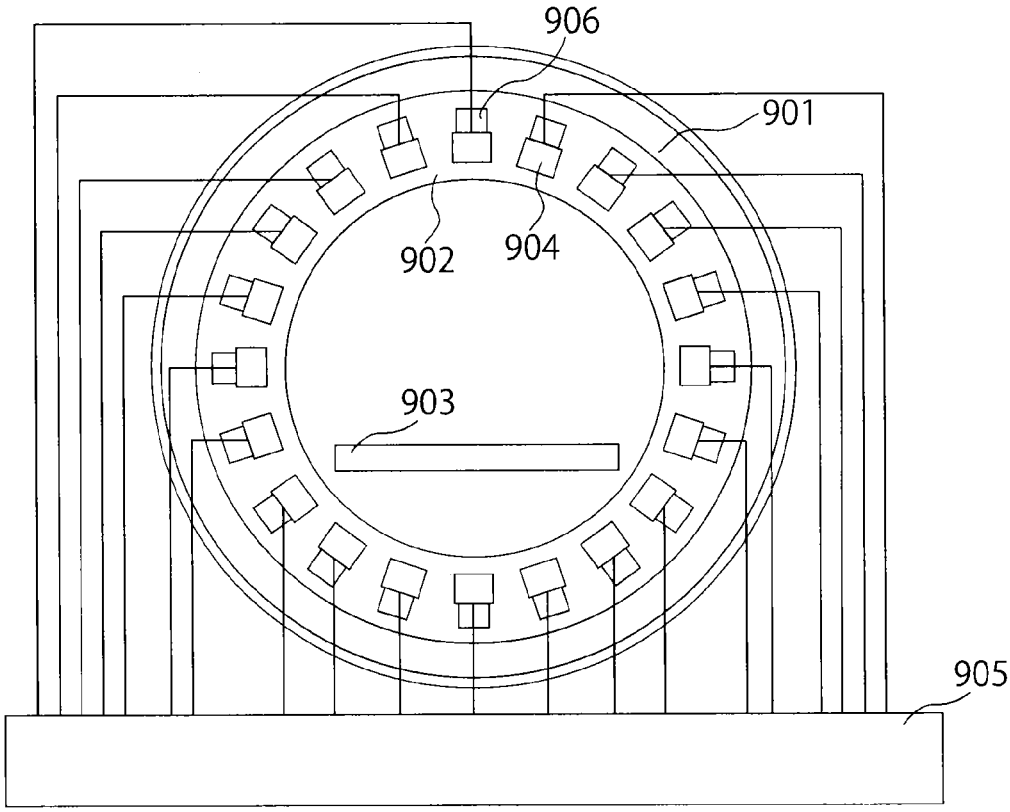
FIG. 9 is a cross sectional schematic view illustrating a magnetic resonance imaging device according to an embodiment having a receiving antenna inside of a housing.

With regard to the fifth embodiment, FIG. 9 illustrates a cross sectional schematic diagram of a magnetic resonance imaging (MRI) apparatus having receiving coils 904 in a housing 902. The magnetic resonance imaging apparatus in the schematic diagram of FIG. 9 includes a magnetostatic source 901, receiving antennas 904, cooling mediums 906, which are provided in the housing 902, and also includes a bed 903 and a reception unit 905. The receiving antenna 904 is arranged inside (at the side of the bed) than the magnetostatic source 901. An output unit, not shown, of each receiving antenna 904 and the reception unit 907 are connected via a wire, and the signal received by the receiving antenna 904 passes through the wire and is transmitted to the reception unit 907. In FIG. 9, twenty receiving antennas 904 are used.

When superconductor antenna is used, the antenna can be reduced to an extremely small size, and many antennas can be arranged in the housing.

When the magnetic resonance imaging apparatus is such that the diameter of a hollow opening portion of the housing 902 (measurement target area) is 70 cm and the external magnetic field strength is 1.5 T, for example, fifty 64 MHz receiving antennas 904 can be arranged in a row inside of the superconducting coil 901 which is the magnetostatic source. Further, multiple rows (e.g., several dozen rows) of receiving antennas 904, which are fifty receiving antennas 904 per row, may be arranged. An image can be captured using an extremely large number of receiving antennas 904, and therefore, a high resolution image-capturing can be achieved, which could not be done with externally-attached receiving antennas. With regard to these issues, a conventional receiving coil is required to be substantially in contact with the measurement target because it is difficult to reduce the size due to the increase of the loss and in order to improve the sensitivity. Because of the limitation of the size and the sensitivity characteristics of the externally-attached receiving antennas, the antenna cannot be placed in the housing 902 inside of the superconducting coil 901 even if tried to do so. Even if the externally-attached antennas are placed in the housing inside of the superconducting coil 901 which is not practical, the maximum number of externally-attached antennas that can be placed is about 10 because of its size. In the embodiment, the small superconducting antenna is used for the receiving antenna 904, and the increase of the loss caused by the smaller antenna is suppressed, and further, multiple superconducting small antennas are made into the array to achieve a higher sensitivity, and therefore, the characteristics can be obtained even if the antennas are placed away from the measurement target, and in addition, the antennas are small, and therefore, several dozen antennas can be arranged inside of the superconducting coil 901, and this enables the measurement to be performed with a higher sensitivity than the conventional case. Because of the higher directivity, information obtained by a single antenna element is information from a narrow area, which further improves the SN ratio. Such information is made into digital data, so that data can be processed at a higher speed than the conventional case. In addition, the circuit for AD-converting (from analog to digital) information obtained by the antenna element is cooled in the same manner as the antenna, so that this eliminates thermal fluctuation during AD conversion, and the data loss caused by the AD conversion can be alleviated.

Sixth Embodiment

Figure 10:
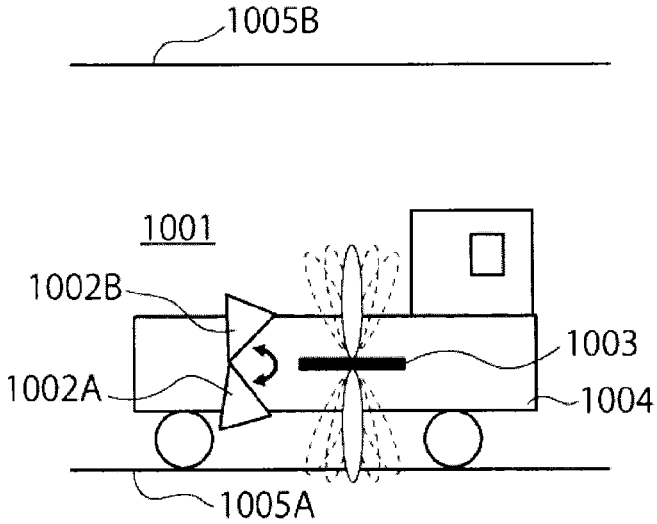
FIG. 10 is a schematic view illustrating an inspection device according to an embodiment.

The sixth embodiment relates to an inspection apparatus using a superconducting antenna device. FIG. 10 illustrates a schematic diagram of an inspection apparatus 1001 according to the sixth embodiment. For example, this apparatus is a nondestructive inspection apparatus used for inspection of deteriorated infrastructure and the like, or inspection during disaster, and is an inspection apparatus configured to emit microwave and detect the reflection wave. This apparatus 1001 includes a transmitter 1002 (AB), a receiver 1003, and a carrying device 1004 for carrying them. The receiver 1003 includes phased array antenna to electrically scan the beam, thus capable of inspecting a desired portion at a high speed and with a high sensitivity. The inspection is done while the vehicle moves with the transmission/reception device carried on the vehicle, so that inspection of infrastructure, which takes an enormous amount of time, can be done at a high speed.

Figure 11:
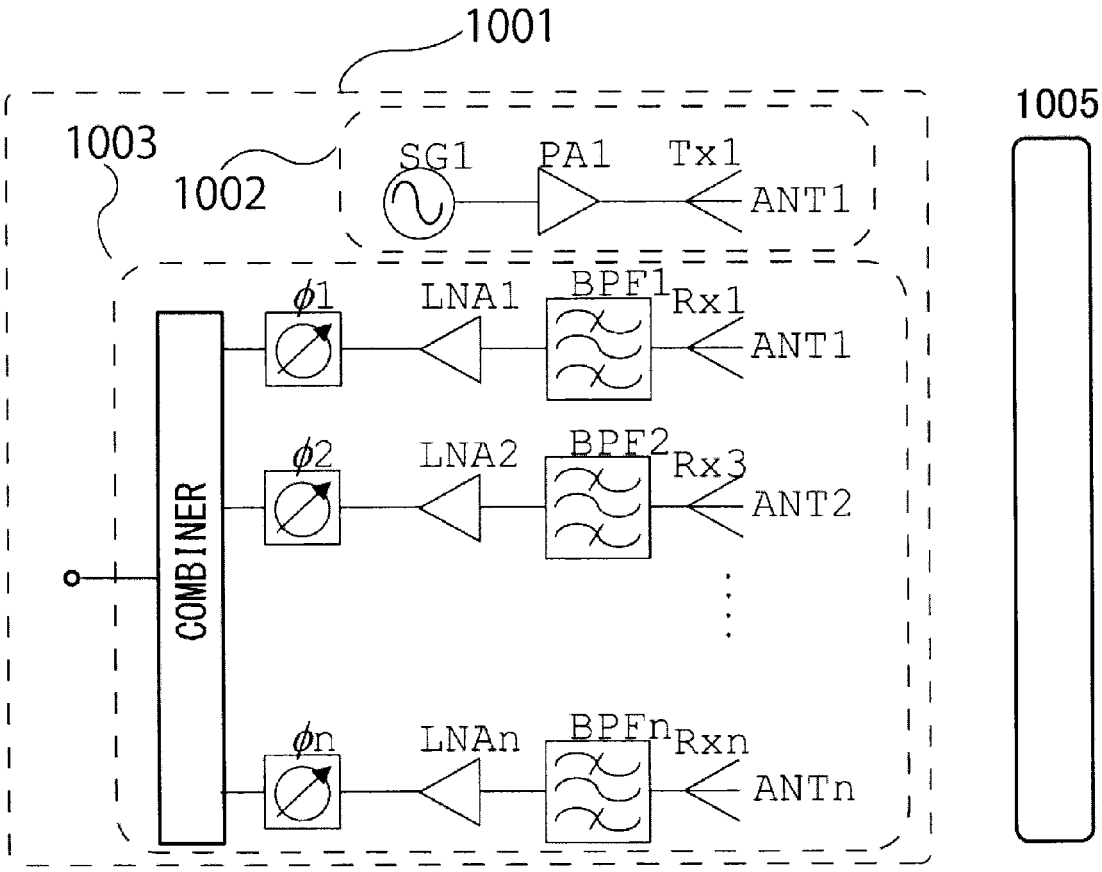
FIG. 11 is a schematic view illustrating a configuration of a transmission/reception device of the inspection device according to the embodiment.

FIG. 11 illustrates a configuration schematic diagram of a transmission/reception device of this apparatus. FIG. 11 is a configuration schematic view in which there are multiple receivers 1003. The transmitter 1002 includes a signal source (SG), a power amplifier (PA), and a transmission antenna (Tx ANT). It should be noted that the transmission signal may be a modulated wave other than a CW wave (unmodulated continuous wave). When a band limitation is applied to the transmission signal, a low pass filter or a band pass filter may be used in a stage after the power amplifier. A signal transmitted from the transmitter 1002 is emitted on an inspection target 1005 (AB) and is reflected thereby. Subsequently, the signal reflected by the inspection target 1005 (AB) is received by the receiver 1003. In this case, in order to improve the reception sensitivity, the receiver of this apparatus uses a structure of an array antenna using multiple antennas. The signal received from the receiving antenna (Rx ANT) of the receiver 1003 is filtered by the band pass filter (BPF), and is input into the low noise amplifier (LNA). The phase shifter (Φ) adjusts the phase of the signal amplified by the low noise amplifier, and the signal is input into the signal combiner, which combines the signals. By performing the signal processing on the combined signal, for example, deteriorated portions and the like are detected. In this case, the phases of the antennas are scanned so as to scan the beam in a particular direction, and in the beam direction, the signal can be detected with a high sensitivity. In FIG. 10, the beam scanning is indicated by elliptic circles. The antenna gain increases as the number of antenna elements increases, and therefore, it is preferable to provide more antenna elements.

In this case, the frequency used in this apparatus is determined according to how deep in the inspection target the inspection is performed, what kind of object is the inspection target, and the like. The attenuation level of the signal emitted to the inspection target and reflected thereby generally becomes higher as the signal becomes a higher frequency, and therefore, in order to inspect a deeper position, it is desired to use a frequency as low as possible. However, when the frequency is low, the antenna size increases, and therefore, when the antennas are made into an array, there is a problem in that the antennas do not fit within the apparatus. For example, when an 8 by 8 array antenna is made with a signal of 1 GHz, one side of the size of the array antenna is more than one meter, and the antenna becomes large. Therefore, in this apparatus, the array antenna structure using the multiple superconducting small antennas according to the embodiment is used for the receiving antenna. Therefore, for example, one side of the 8 by 8 array antenna becomes about several dozen centimeters, and a small array antenna device can be achieved. Therefore, this enables the inspection apparatus to use the structure of the phased array antenna. In order to perform inspection with a higher degree of precision, the used frequency band may be an extremely-high frequency band such as 50 GHz which is a frequency higher than the microwave band. When the extremely-high frequency band is used, the attenuation is higher than the microwave band, and this reduces the depth that can be inspected in the depth direction, but a very small broken portion and the like can be detected with a shorter wavelength. When the extremely-high frequency band is used, the size of the antenna is smaller than the microwave band, and therefore, the array antenna can be configured to have more elements, and a beam having an extremely high directivity can be formed. Therefore, the sensitivity of the antenna can be increased.

While certain embodiments have been described, these embodiments have been presented by way of example only, and are not intended to limit the scope of the inventions.

Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A superconducting antenna device comprising:

an array antenna made by stacking a flat antenna having one or more antennas made of a superconducting material and a ground pattern on a low-loss dielectric substrate from a short wave band to an extremely-high frequency band;

a vacuum chamber configured to accommodate the array antenna;

a refrigerator configured to cool the array antenna; and a vacuum insulating window configured to pass an electromagnetic wave from a short wave band to an extremely-high frequency band in a direction of directivity of the array antenna in the vacuum chamber.

2. The device according to claim 1, wherein two or more antennas made of the superconducting material are provided on the same surface, and a distance between adjacent antennas made of the superconducting material is equal to or less than 1/10 of an resonant frequency of the antenna made of the superconducting material.

3. The device according to claim 1, wherein the one or more antennas made of the superconducting material is connected to a feeding path, and the feeding path is provided with a delay circuit.

4. The device according to claim 1, wherein the one or more antennas made of the superconducting material is connected to a feeding path, and the feeding path is provided with a resistance.

5. The device according to claim 1, wherein the one or more antennas made of the superconducting material is any of monopole, dipole, inverted F, crank, spiral, CPW, and slot types.

6. The device according to claim 1, wherein the one or more antennas made of the superconducting material is a spiral type, and the longest side of the antenna made of the superconducting material is equal to or less than 1/10 of a wiring length of the antenna made of the superconducting material.

7. The device according to claim 1, wherein an infrared reflection film is provided in a directivity direction on a surface of the array antenna.

8. The device according to claim 1, wherein the one or more antennas made of the superconducting material is connected to an amplitude limiter, a band pass filter, a low noise amplifier, and a phase shifter.

9. The device according to claim 8, wherein the amplitude limiter, the band pass filter, and the low noise amplifier is cooled by the refrigerator.

* * * * *